US009728369B2

(12) United States Patent
Hans

(10) Patent No.: US 9,728,369 B2
(45) Date of Patent: Aug. 8, 2017

(54) TWO-PART HIGH VOLTAGE VACUUM FEED THROUGH FOR AN ELECTRON TUBE

(71) Applicant: incoatec GmbH, Geesthacht (DE)

(72) Inventor: Karl Hans, Lueneburg (DE)

(73) Assignee: incoatec GmbH, Geesthacht (DE)

( * ) Notice: Subject to any disclaimer, the term of this patent is extended or adjusted under 35 U.S.C. 154(b) by 169 days.

(21) Appl. No.: 14/693,908

(22) Filed: Apr. 23, 2015

(65) Prior Publication Data

US 2015/0325400 A1 Nov. 12, 2015

(30) Foreign Application Priority Data

May 9, 2014 (DE) ..... 10 2014 208 729

(51) Int. Cl.

| | |
|---|---|
| ***H01J 35/12*** | (2006.01) |
| ***H01J 9/24*** | (2006.01) |
| ***H01J 9/14*** | (2006.01) |
| ***H01J 35/16*** | (2006.01) |

(52) U.S. Cl.

CPC ..... *H01J 35/12* (2013.01); *H01J 9/14* (2013.01); *H01J 9/24* (2013.01); *H01J 35/16* (2013.01); *H01J 2235/0233* (2013.01)

(58) Field of Classification Search

CPC ..... H01J 35/12

See application file for complete search history.

(56) References Cited

U.S. PATENT DOCUMENTS

| | | | | |
|---|---|---|---|---|
| 3,979,187 | A * | 9/1976 | Scherer | H01J 5/34 174/152 GM |
| 4,950,962 | A * | 8/1990 | Birnbach | G21K 1/02 313/293 |
| 5,903,088 | A * | 5/1999 | Sugitani | H01J 61/30 313/113 |
| 6,353,658 | B1 * | 3/2002 | Trebes | A61N 5/1001 378/119 |
| 2006/0102835 | A1 * | 5/2006 | Laser | H01J 49/068 250/282 |

(Continued)

FOREIGN PATENT DOCUMENTS

| | | |
|---|---|---|
| DE | 967 320 | 10/1957 |
| DE | 1 045 305 | 11/1958 |

(Continued)

*Primary Examiner* — David Porta
*Assistant Examiner* — Jeremy S Valentiner
(74) *Attorney, Agent, or Firm* — Paul Vincent

(57) ABSTRACT

A high voltage vacuum feed through (23) for an electron tube (25) has an anode (28) and an insulating body (1) of ceramic material, the insulating body (1) having a continuous hollow space (10). The anode (28) has a rear part (2) and a front part (3) mounted thereto. The rear part (2) consists of a first metallic material, having a thermal expansion coefficient corresponding to a thermal expansion coefficient of the ceramic material. The rear part (2) is arranged in the hollow space (10) of the insulating body (1) and is soldered into the insulating body (1) in a vacuum-tight fashion. The front part (3) has a second metallic material whose heat conductivity is larger than that of the first metallic material. The high voltage vacuum feed through reliably remains vacuum-tight during operation and can be easily provided with different target materials.

15 Claims, 4 Drawing Sheets

(56) References Cited

U.S. PATENT DOCUMENTS

| | | | | |
|---|---|---|---|---|
| 2006/0165221 | A1 | 7/2006 | Holm | |
| 2007/0041503 | A1* | 2/2007 | Lenz | H01J 35/105 378/143 |
| 2009/0267513 | A1 | 10/2009 | Trypke | |
| 2009/0267515 | A1 | 10/2009 | Hendricx | |
| 2011/0095684 | A1* | 4/2011 | Moriyasu | H01J 61/363 313/637 |

FOREIGN PATENT DOCUMENTS

| | | |
|---|---|---|
| DE | 10 2009 017 924 | 11/2010 |
| WO | WO 01/18842 | 3/2001 |

* cited by examiner

TWO-PART HIGH VOLTAGE VACUUM FEED THROUGH FOR AN ELECTRON TUBE

This application claims Paris convention priority from DE 10 2014 208 729.5 filed May 9, 2014 the entire disclosure of which is hereby incorporated by reference.

BACKGROUND OF THE INVENTION

The invention concerns a high voltage vacuum feed through for an electron tube, in particular, for a solid anode X-ray tube, comprising

- an insulating body of ceramic material, wherein the insulating body has a continuous hollow space,
- and an anode, wherein a rear end of the anode is arranged in the hollow space of the insulating body and seals the hollow space in a vacuum-tight fashion.

A vacuum feed through of this type is disclosed e.g. in DE 10 2009 017 924 A1.

X-ray radiation is used in various ways in instrumental analysis or also for producing image recordings of human and animal patients in medicine. X-ray radiation is typically generated in an X-ray tube through emission of electrons from an electrically heated electron emitter and acceleration of the electrons in the electrical field to a so-called target, from which characteristic X-ray radiation is emitted. The target material differs in dependence on the application. The electron emitter is part of a cathode and the target is part of an anode.

In order to be able to sufficiently accelerate the electrons towards the target, the space between the cathode and the anode must be evacuated and a high voltage (typically some kilovolts) must also be applied between the cathode and the anode. In most cases, a high voltage is applied to the anode, which requires a corresponding vacuum-tight feed through. A high voltage vacuum feed through usually comprises a ceramic body as electric insulator with a central opening into which a high voltage lead and an electrode are inserted in a vacuum-tight fashion, cf. EP 1 537 594 B1.

In one embodiment of DE 10 2009 017 924 A1, the anode is produced of copper and is soldered into a tubular ceramic insulating body of aluminium nitride in a vacuum-tight fashion.

However, copper and ceramic materials such as aluminium nitride have quite different thermal expansion coefficients such that, during soldering or also due to load (and heating) during operation, large mechanical stress may be generated which can result in that the soldering joints leak. The X-ray tube is then useless.

DE 10 2009 924 A1 proposes to form elastic claws on the outside of the anode. These claws can elastically absorb the mechanical stress and also adjust the heat flow. Alternatively, the anode could terminate in a soft-annealed hollow cylindrical section, where only small mechanical stress is generated.

The production of elastic claws on the anode is very complex and vacuum-tight soldering to the ceramic insulating body is much more complicated in comparison with an anode having a smooth outer wall. An anode with a hollow-cylindrical section is only suited for relatively small heat flows, i.e. X-ray tubes with a comparatively small power. Another point is that the hollow-cylindrical section may easily become deformed during installation, which again aggravates vacuum-tight soldering.

The relatively complex process of installing an anode into a ceramic insulating body moreover results in comparatively long delivery periods in case it is not intended to stock finished vacuum feed throughs for any target type. In accordance with prior art, it is hardly possible to change the target at the front end of the anode after installation of an anode into the insulating body.

It is the underlying purpose of the present invention to provide a high voltage vacuum feed through which is easy to produce, can be designed to be reliably vacuum-tight and also remains reliably vacuum-tight during operation, in particular, wherein the high voltage vacuum feed through can also be easily equipped with different target materials.

SUMMARY OF THE INVENTION

This object is achieved by a high voltage vacuum feed through of the above-mentioned type which is characterized in that the anode is designed in two parts with a rear part and a front part, that the rear part consists of a first metallic material, the thermal expansion coefficient $\alpha_{ht}$ of which corresponds to the thermal expansion coefficient $\alpha_{ker}$ of the ceramic material, that the rear part is arranged in the hollow space of the insulating body and is soldered into the insulating body in a vacuum-tight fashion, that the front part consists at least partially of a second metallic material, the heat conductivity $\lambda_{vt}$ of which is larger than the heat conductivity $\lambda_{ht}$ of the first metallic material of the rear part, and that the front part is mounted to the rear part.

In accordance with the present invention, the anode is designed in two parts in order to better meet the practical requirements for this component.

A rear part of the anode is primarily used for mounting in the ceramic insulating body. The first metallic material of the rear part is selected in such a fashion that its thermal expansion coefficient $\alpha_{ht}$ corresponds to the thermal expansion coefficient of the ceramic material of the insulating body $\alpha_{ker}$ such that during soldering and also during operation of the electron tube (in which the anode is heated) no or only minimum mechanical stress is generated such that the tightness of the soldering joint between the rear part and the insulating body is not impaired. In particular, the rear part can be soldered into the insulating body with a very narrow gap (e.g. 50 μm gap width or less), which can easily be bridged or sealed with solder. The rear part is generally soldered in a vacuum-tight fashion into the hollow space in the front half of the insulating body.

The linear thermal expansion coefficients $\alpha_{ht}$ and $\alpha_{ker}$ correspond to each other, in particular, when $\alpha_{ht}$ differs maximally by 50%, preferably maximally by 25% from $\alpha_{ker}$ (referred to $\alpha_{ker}$). $\alpha_{ht}$ is preferably not larger than $\alpha_{ker}$. $\alpha_{ht}$ is typically approximately $5\text{-}6*10^{-6}$ 1/K, in particular approximately $5.5*10^{-6}$ 1/K for Fernico, and $\alpha_{ker}$ approximately $6.5\text{-}8.9*10^{-6}$ 1/K, in particular approximately $7*10^{-6}$ 1/K for $Al_2O_3$ ceramic material.

The front part of the anode is primarily used to dissipate heat from the target, i.e. from the area of the anode that is irradiated by electrons. In the simplest case, the target is formed by a front end of the front part, or the target is a coating or a top part (mostly soldered) or an insert at the front end of the front part. The front part consists completely or partially (except for the target) of the second metallic material, the thermal Conductivity $\lambda_{vt}$ of which is larger than the thermal conductivity of the first metallic material $\lambda_{ht}$. Typically, $\lambda_{vt} \geq 5*\lambda_{ht}$ and preferably $\lambda_{vt} \geq 10*\lambda_{ht}$. The relatively high thermal conductivity of the second metallic material enables efficient dissipation of the heat generated at the target.

$\lambda_{vt}$ is typically approximately 300-400 W/(m*K), in particular approximately 380 W/(m*K) for copper, and $\lambda_{ht}$ is approximately 10-30 W/(m*K), in particular approximately 16.7 W/(m*K) for Fernico.

The rear part can be soldered into the insulating body independently of the front part and therefore independently of the desired target material. When the target material for the electron tube has been determined, a corresponding front part can subsequently be mounted to the soldered rear part. It is sufficient to hold available just one type of partially mounted vacuum feed through (including insulating body and soldered rear part) for all target material types. A variety of corresponding front parts (also called anode heads) can be kept in store for different target materials.

The rear part and the front part can be connected in any suitable fashion permitting sufficient heat transfer between the front part and the rear part and ensuring good electrical contact. Welding or soldering is preferably avoided in order not to subsequently impair the solidity or tightness of the solder joint between the rear part and the insulating body. The connection generally provides permanent flat tactile contact between the front part and the rear part. In particular, placing on top/inserting into each other and shrinking have proven to be useful for the connection. Another possibility would be screwing on top of each other/screwing into one another, where applicable, using a securing pin.

In one preferred embodiment of the inventive vacuum feed through, the rear part and the front part are inserted into one another. A large contact surface can be easily provided by means of a plug connection. The plug connection can moreover be fixed by shrinking or also by means of a securing pin.

In one advantageous further development of this embodiment, the rear part has a receiving section with a recess at its front end, the front part has a plug-in section at its rear end, and the plug-in section is inserted into the receiving section. In this case, the heat can be radially transferred through the wall of the receiving section of the rear part into the insulating body over a very short path from the plug-in section of the front part. In case of shrinking, the front part, which is robust and easy to handle, can additionally be refrigerated for contraction (e.g. in liquid nitrogen) and the insulating body including rear part can be gently heated (in an oven e.g. at approximately 200° C.) in order to widen the receiving section.

The front part preferably has a longitudinal bore towards the bottom of the recess of the receiving section and also a transverse bore which is connected to the longitudinal bore, wherein the transverse bore terminates outside of the receiving section. When inserting the front and rear parts into each other, gas (in particular air) can be reliably discharged through the longitudinal bore and the transverse bore to the outside of the recess of the receiving section. This prevents gas occlusions that could impair the heat transfer or also cause mechanical stress during operation.

The rear part and the front part are preferentially connected to each other through shrinking. This provides a very reliable, mechanically highly solid connection between the front and rear parts without solder or additional mounting or securing means. Towards this end, the part to be inserted (typically the front part) is significantly cooled, e.g. in liquid nitrogen and/or the receiving part (typically the rear part) is heated (e.g. to 200° C. but without weakening the solder connection to the insulating body). The two parts are then inserted into one another with only little play, e.g. 4/100 mm or less relative to the diameter of the receiving section. When the inserted part is subsequently heated, it expands and the receiving part cools and shrinks. The two parts finally block the geometrical changes caused by heat of the respective other part. In this fashion, the two parts are elastically tensioned with respect to each other and rigidly connected to each other. In composite form after connection, the inserted part is then under compressive stress and the receiving part is under tensile stress.

In one advantageous embodiment, the ceramic material of the insulating body is $Al_2O_3$ and the first metallic material of the rear part is made of an iron nickel cobalt alloy, in particular, with weight portions of Fe=53-54%, Ni=28-29%, Co=17-18%. The stated weight portions of the iron-nickel-cobalt alloy correspond to a so-called Fernico alloy. $Al_2O_3$ ceramic material and Fernico have thermal expansion coefficients that match very well, with $\alpha(Al_2O_3)$ of approximately $7*10^{-6}$ 1/K and $\alpha$(Fernico) of approximately $5.5*10^{-6}$ 1/K. This material combination has proven advantageous in practice.

In another particularly preferred embodiment, the second metallic material, of which the front part fully or partially consists, is Cu. Copper has a very good thermal conductivity of approximately 380 W/(m*K) and therefore provides very efficient dissipation of heat from the target. If the front part is completely produced of Cu, the front part is directly used as the target.

In another likewise preferred embodiment, the front end of the front part is provided with a coating, a top part or an insert of molybdenum, tungsten, rhodium, silver, cobalt, or chromium. The coating, top part or insert is used as a target in order to be able to utilize the characteristic X-ray emission lines of the associated material. A top part is typically soldered onto the front part of the anode. An insert is inserted into a depression at the front of the front part and generally fixed by soldering or casting (e.g. with copper). A coating may e.g. be applied through sputtering. Since only the coating, the top part or insert consist of the particular target material, the properties of the second metallic material (mostly copper) can still be utilized, e.g. high thermal conductivity.

In another advantageous embodiment, the rear end of the rear part has a connector section with a recess for receiving a high voltage plug. A plug connection for connecting the high voltage line is easy to establish and has proven itself in practice.

In a preferred embodiment, the insulating body has a wall thickness WSv in a front area, which is larger than a wall thickness WSm in a central area, wherein the rear part extends at least partially in the central area, in particular, wherein WSm≤⅔*WSv, and in particular wherein at least ⅔ of the length of the rear part extends in the central area. The insulating body has comparatively poor thermal conductivity. Thinning in the central area improves dissipation of heat from the anode, in particular, towards a cooling device seated on top, especially since thermal conduction in the rear part of the anode is relatively poor in most cases. This improves protection of the high voltage connection. The larger wall thickness in the front part improves electrical insulation, in particular, by a long path along the surface of the insulating body from the anode to a (generally earthed) housing or outer area. The insulating body moreover typically has a rear area where the wall thickness is again increased compared with the central area such that the insulating body has an approximately dumbbell shape. This improves support for a superimposed cooling device.

In an advantageous further development of this embodiment, a cooling device is seated on an outside of the central area of the insulating body. The cooling device improves dissipation of heat from the insulating body, in particular, in the thinned central area.

In this case, the cooling device preferably comprises a metallic sheathing of the insulating body, in particular, wherein the metallic sheathing is produced of copper or aluminium. The metallic sheathing can transport heat away from the insulating body and distribute it over the length of the metallic sheathing with higher thermal conductivity than the material of the insulating body, thereby preventing local overheating in the area of the anode. The metallic sheathing is typically made of several parts, e.g. two parts, in order to facilitate mounting to the insulating body. The metallic sheathing is typically considerably longer than the rear part, e.g. more than twice as long as the rear part. The metallic sheathing may comprise cooling ribs and/or be surrounded by a cooling air flow. A coolant flow, e.g. air or water, through the cooling device is possible but only rarely required in practice.

In a further preferred embodiment of the inventive vacuum feed through, the rear part is soldered into the insulating body with a solder containing Ag or Au, wherein the insulating body has a nickel-plated MoMn coating at least in the soldered area. In this fashion, the metallic rear part can be soldered to the ceramic insulating body in a reliable, vacuum-tight manner.

The present invention also concerns an electron tube, in particular, a solid anode X-ray tube comprising an inventive vacuum feed through as described above. The electron tube is very reliable and failure due to leakage of the vacuum feed through, in particular due to heating during operation, is unlikely.

The invention also concerns a method for producing an above-described vacuum feed through in accordance with the invention, comprising the following steps:

a) production of the insulating body, b) insertion of the rear part of the anode into the hollow space of the insulating body and vacuum-tight soldering of the rear part into the insulating body;

c) mounting the front part of the anode to the rear part. The inventive procedure guarantees tightness of the vacuum feed through with great reliability. The production method is also very flexible with respect to the target material of the front part.

In a preferred variant of the inventive method, the front part is mounted to the rear part in step c) through placing on top and shrinking. This provides a high-strength connection between the front and rear parts of the anode without solder or additional connecting means, in particular, without any problems after step b).

In another advantageous variant, steps a) and b) are initially performed for a plurality of vacuum feed throughs and the partly finished vacuum feed throughs are subsequently provided with front parts either individually or in groups in accordance with step c), wherein a plurality of different types of front parts is used. This process utilizes a supply of partly finished vacuum feed throughs for different target materials. The front and rear parts can be very quickly connected, e.g. via fitting over and shrinking, such that a vacuum feed through having an anode with a specific target material can be provided and supplied within a short time.

Further advantages of the invention can be extracted from the description and the drawing. The features mentioned above and below may be used in accordance with the invention either individually or collectively in arbitrary combination. The embodiments shown and described are not to be understood as an exhaustive enumeration, rather have exemplary character for describing the invention.

The invention is shown in the drawing and is explained in more detail with reference to embodiments. In the drawing:

DESCRIPTION OF THE PREFERRED EMBODIMENT

Figure 1:
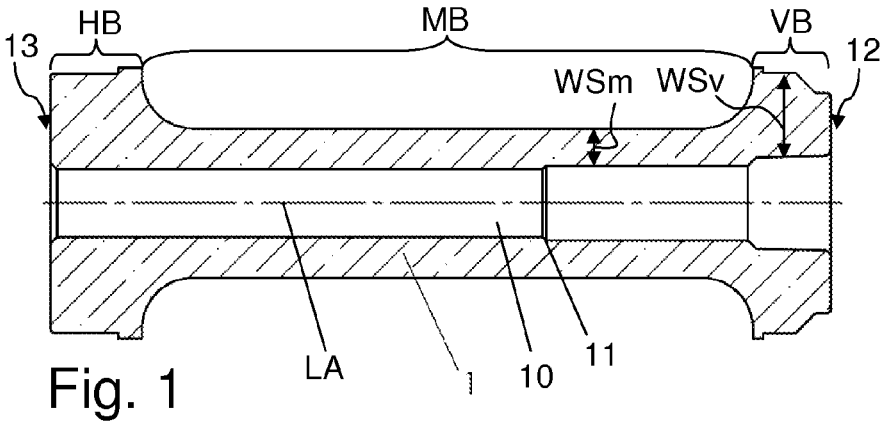
FIG. 1 shows a schematic longitudinal section through a ceramic insulating body in the form of a dumbbell for a high voltage vacuum feed through in accordance with the invention.
Figure 2:
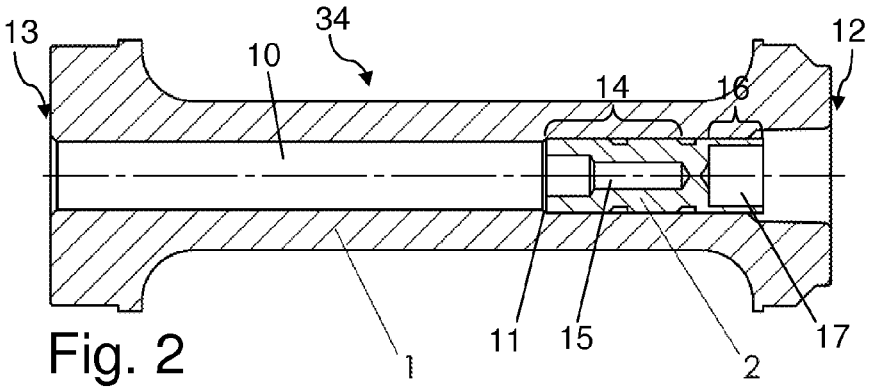
FIG. 2 shows a schematic longitudinal section through a partly finished high voltage vacuum feed through in accordance with the invention with an insulating body in the form of a dumbbell in accordance with FIG. 1.
Figure 3:
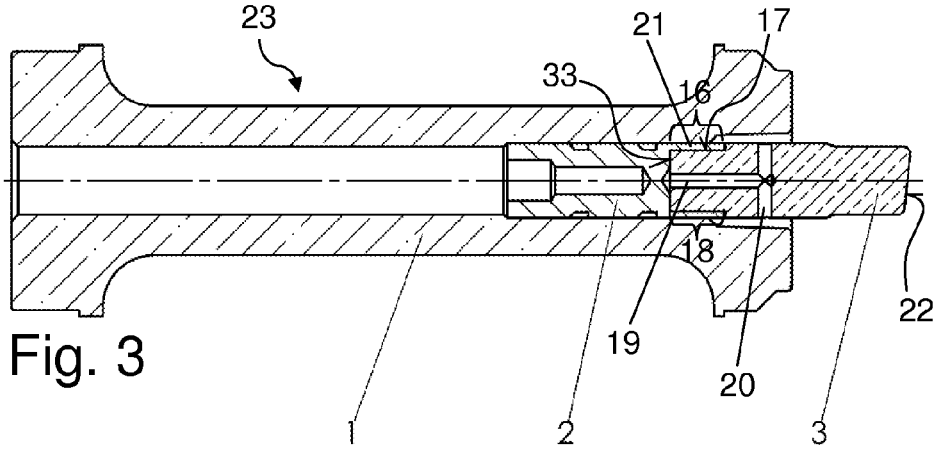
FIG. 3 shows a schematic longitudinal section through a high voltage vacuum feed through in accordance with the invention with an insulating body in the form of a dumbbell and a rear part of an anode in accordance with FIG. 2.

FIGS. 1 through 3 show the production of an inventive high voltage vacuum feed through in different chronologically successive stages.

A ceramic insulating body 1 is initially produced or provided, cf. FIG. 1. In the present case, the insulating body 1 is produced from aluminium oxide ceramic material, e.g. through slip casting or other conventional forming technologies, followed by sintering. If desired or required, the $Al_2O_3$ ceramic material may contain sintering aids or other additives for optimizing the production process or the quality of the sintered ceramic material in a manner known per se.

The insulating body 1 is substantially configured to be tubular and has, in particular, a continuous hollow space 10 that extends in a longitudinal direction (cf. longitudinal axis LA) similar to a bore. The insulating body 1 is rotationally symmetrical with respect to the longitudinal axis LA in this case. The hollow space 10 has a step 11 that serves as a stop for a rear part of an anode to be inserted from the front (in the present case right-hand) end 12 (cf. FIG. 2). A high voltage line can be guided to the anode (not shown) from a rear (in the present case left-hand) end 13.

In a front area VB, the insulating body 1 additionally has an (average) wall thickness WSv that is larger than the (average) wall thickness WSm in a central area MB. The (average) wall thickness WSh is moreover again larger in a rear area HB than in the central area MB. For this reason, the insulating body has the shape of a dumbbell. The front area VB, the central area MB and the rear area HB extend together over the overall axial length of the insulating body 1.

A rear part 2 of an anode is then inserted into the insulating body 1 or its hollow space 10, cf. FIG. 2 and is soldered on its outside along its circumference to the inner wall of the hollow space 10. Towards this end, the insulating body 1 may initially be provided on the inside with a MoMn coating at least in an area bordering step 11 on the right hand side, e.g. via a CVD method and be soldered with a solder containing Ag or Au. Soldering is performed in a vacuum-tight fashion, which is easy to realize when the gap between the rear part 2 and the inner wall of the insulating body 1 is sufficiently small. In the present case, the rear part 2 is produced from a Fernico alloy, the thermal expansion coefficient of which corresponds to the thermal expansion coefficient of the insulating body 1 (both with respect to the radial direction and also axial longitudinal direction).

The rear part 2 and the joint seal the hollow space 10 close to the front end 12 in a vacuum-tight fashion, i.e. gas exchange between the front end 12 and the rear end 13 via the hollow space 10 is no longer possible.

The rear end of the rear part 2 is provided with a connector section 14 having a recess 15 for receiving a high voltage plug (the latter is not shown in detail). The front end of the rear part 2 is provided with a receiving section 16 with a recess 17 for receiving a plug-in section of a front part of the anode (cf. FIG. 3 in this connection).

The insulating body 1 with soldered rear part 2 of the anode, however without installed front part, is also called partly produced vacuum feed through 34.

A front part 3 of the anode is then mounted, cf. FIG. 3, for completing the vacuum feed through 23. The rear end of the front part 3 is provided with a plug-in section 18 that is inserted into the recess 17 of the rear part 2.

Towards this end, the front part 3 is initially significantly cooled down, typically to the temperature of liquid nitrogen (approximately 77K), through insertion into the liquid nitrogen such that the plug-in section 18 is radially contracted. The rear part 2 is additionally heated together with the insulating body 1, e.g. in an oven, to 200° C. such that the recess 17 radially widens. With these temperature conditions, the plug-in section 18 may be just about inserted into the recess 17. As soon as the temperature conditions normalize, i.e. the front and rear parts 3, 2 have the same temperature, the recess 17 has been radially contracted and the plug-in section 18 has been radially widened to such an extent that the front and rear parts 3, 2 are radially clamped and can no longer be removed from each other.

In order to prevent air occlusions between the recess 17 and the plug-in section 18, in particular at the bottom 33 of the recess 17, during fitting, the front part 3 has a longitudinal bore 19 and a transverse bore 20 that intersects the longitudinal bore 19. Air can then escape from the bottom 33 of the recess 17 through the bores 19, 20 in case the gap between the side wall 21 of the receiving section 16 and the outer wall of the plug-in section 18 is too small for gas to escape.

In the present case, the front part 3 is completely produced of copper in order to ensure quick and efficient heat transport from the area of the target 22 at the front end of the front part 3 of the anode into the insulating body 1 during operation. The heat thereby flows mainly through the front part 3 to the plug-in section 18, through the side wall 21 of the receiving section 16 of the rear part 2 and partially also through the further rear part 2, into the Insulating body 1.

Figure 7:
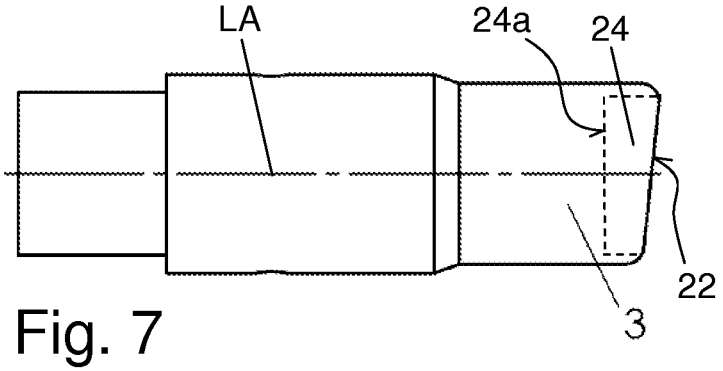
FIG. 7 shows a schematic exterior view of a front part of an anode for an inventive high voltage vacuum feed through with an insert of tungsten at the front end.

If desired, the front end of the front part 3 may be provided with a coating, a top part or an insert made from another material than copper in order to generate characteristic X-ray radiation in correspondence with this other material on the target 22 (cf. FIG. 7 in this case).

The front end of the front part 3 projects out of the insulating body 1. The vacuum feed through 23 is integrated in an electron tube or X-ray tube as intended (cf. FIG. 9 in this case).

Figure 4:
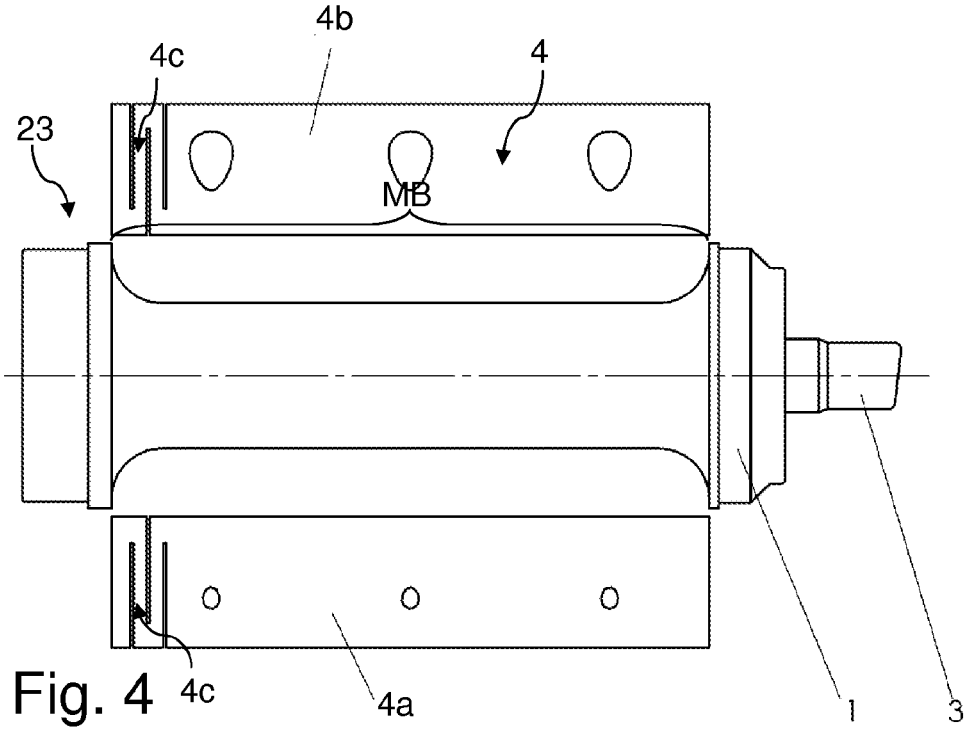
FIG. 4 shows a schematic exterior view of the inventive high voltage vacuum feed through of FIG. 3 with cooling device which has not yet been outwardly seated.

As is shown in FIG. 4, the vacuum feed through 23 may be provided with a cooling device 4 which consists in the present case of a metallic sheathing, preferably of copper or aluminium. In the illustrated embodiment, the sheathing comprises two semi-shells 4*a*, 4*b* which are disposed around the insulating body 1 and surround it through a large area over practically the entire circumference and length of the central area MB. In order to be able to compensate for temperature-related length changes with sufficiently small mechanical stress, each semi-shell 4*a*, 4*b* is provided at its rear end with an area 4*c* having a plurality of slits.

Figure 5:
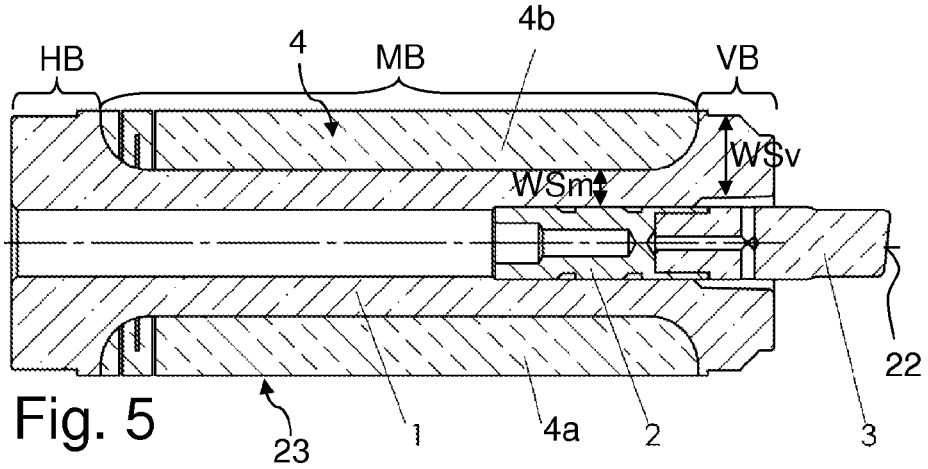
FIG. 5 shows the high voltage vacuum feed through of FIG. 4 in longitudinal section with seated cooling device.

FIG. 5 shows a longitudinal section through the vacuum feed through 23 with installed semi-shells 4*a*, 4*b* disposed on the insulating body 1. The thermal flow coming from the target 22 via the rear part 2 of the anode reaches the semi-shells 4*a*, 4*b* through short paths, namely through the reduced wall thickness WSm of the insulating body 1 in the central area MB (compared with the larger wall thickness WSv in the front area VB).

In the present case, 9/10 of the rear part 2 extend in the longitudinal direction in the central area MB and the (average) wall thickness WSm in the central area MB is approximately ½ times the (average) wall thickness WSv in the front area VB. The heat may be dissipated in the semi-shells 4*a*, 4*b* of the cooling device 4 through the overall length and be discharged/radiated, thereby preventing local overheating of the anode, in particular, of the rear part 2 that is connected to a high voltage plug.

It is generally preferred for the rear part 2 to axially extend at least by ⅔ in an area of the insulating body 1 in which the local radial wall thickness (cf. WSm in the central area MB) of the insulating body 1 is maximally ⅔ of the largest radial wall thickness (cf. WSv in the front area VB) of the insulating body 1.

Figure 6:
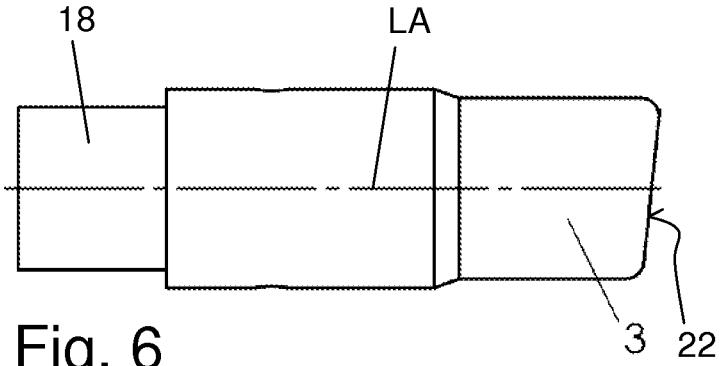
FIG. 6 shows a schematic exterior view of a front part of an anode for an inventive high voltage vacuum feed through which is completely produced of copper.

FIG. 6 shows a front part 3 of an anode for the invention. The part 3 is completely produced of copper. The rear end of the part is provided with a plug-in section 18 and the front end forms the target 22. The flat surface of the target 22 is slightly inclined with respect to the longitudinal axis LA in order to obtain a useful radiation dependence (angular distribution) of the characteristic X-ray radiation excited in the copper by the impinging electrons.

In case the characteristic X-ray radiation of a different material than copper is desired, the front end of the front part 3 may be provided with an insert 24 (dashed lines) made of the other material ("target material"), in the present case tungsten, as target 22, cf. FIG. 7. The insert 24 is arranged in a depression 24*a* in the front part 3 and is fixed (e.g. soldered) normally prior to fixing the front part 3 to the rear part 2. The flat surface of the insert 24 is also inclined with respect to the longitudinal axis LA.

Figure 8:
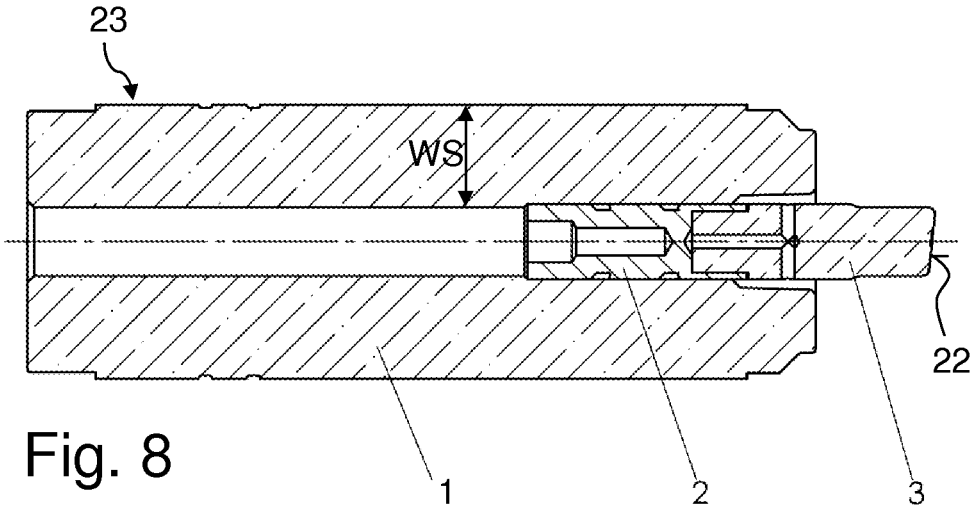
FIG. 8 shows a schematic longitudinal section of an inventive high voltage vacuum feed through with a ceramic insulating body having a substantially uniform wall thickness.

FIG. 8 shows an alternative embodiment of an inventive high voltage vacuum feed through 23, in which the ceramic insulating body 1 has a substantially uniform wall thickness WS. This configuration is particularly simple and can be effectively used for electron tubes or X-ray tubes with little power or little development of heat on the target 22.

Figure 9:
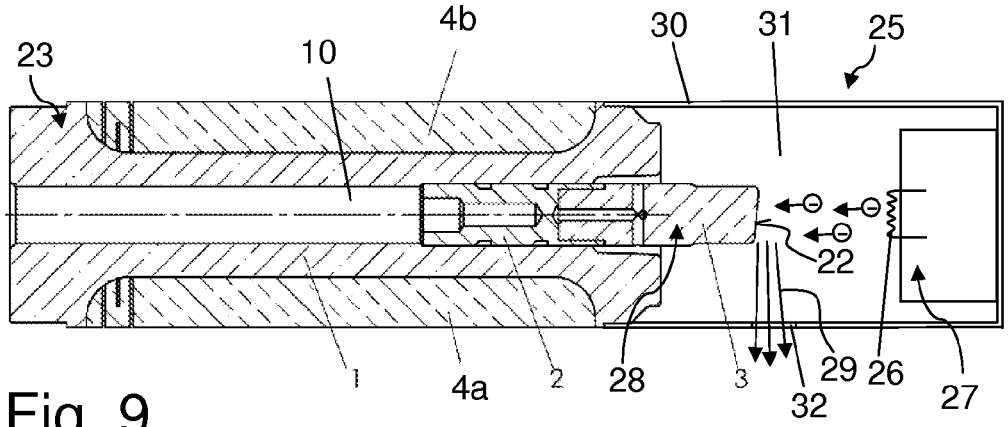
FIG. 9 shows a schematic longitudinal section of an inventive electron tube with an inventive high voltage vacuum feed through in accordance with FIG. 5.

FIG. 9 shows a schematic longitudinal section through an electron tube 25 (in the present case a solid anode X-ray tube) with an inventive vacuum feed through 23 as disclosed in FIG. 5.

A vacuum-tight housing 30 is arranged around the front part 3 of the anode 28 and bordering the insulating body 1, the housing comprising an evacuated space 31. The housing 30 also has a cathode 27 with an electron emitter 26, in the present case an electrically heated coil of tungsten wire.

Electrons are discharged by the electron emitter 26 during operation due to thermionic emission and are accelerated by a high voltage between the cathode 27 and the anode 28 of typically 5 kV to 30 kV through the evacuated space 31 to the anode 28, to be more precise to the target 22 on the front part 3. At this location, in addition to bremsstrahlung, characteristic X-ray radiation 29 is excited which can be discharged through a beryllium window 32 and can be used e.g. for instrumental analysis or medical diagnosis.

Even if the joint between the metallic rear part 2 of the anode 28 and the ceramic insulating body 1 should become hot during operation, the joint will not be subjected to any mechanical stress due to expansion, since the thermal expansion coefficients $\alpha_{ht}$ and $\alpha_{ker}$ of the rear part 2 of Fernico and of the ceramic material $Al_2O_3$ of the insulating body 1 are approximately equal. At the same time, heat is efficiently discharged from the target 22 through the copper material of the front part 3 to the rear (in FIG. 9 towards the left-hand side).

I claim:

1. A solid anode X-ray tube, the tube having a voltage vacuum feed through, wherein the feed through comprises:

an insulating body made of ceramic material, said insulating body having a continuous hollow space; and an anode, said anode having a two-part design with a rear part and a front part, said front part having a target to produce X-rays, said rear part being made from a first metallic material having a thermal expansion coefficient $\alpha_{ht}$ which differs by at most 50% from a thermal expansion coefficient $\alpha_{ker}$ of said ceramic material, wherein said rear part is arranged in said hollow space of said insulating body and is soldered into said insulating body to seal said hollow space in a vacuum-tight fashion, said front part comprising a second metallic material having a heat conductivity $\lambda_{vt}$ which is larger than a heat conductivity $\lambda_{ht}$ of said first metallic material of said rear part, wherein said front part is mounted to said rear part, wherein said insulating body has a wall thickness WSv in a front area which is larger than a wall thickness WSm in a central area and said rear part extends at least partially in said central area, wherein WSm≤⅔*WSv and at least ⅔ of a length of said rear part extends in said central area and further comprising a cooling device seated on an outside of said insulating body in said central area.

2. The solid anode X-ray tube of claim 1, wherein said rear part and said front part are inserted into each other.

3. The solid anode X-ray tube of claim 2, wherein said rear part comprises a receiving section having a recess at a front end thereof and said front part has a plug-in section at a rear end thereof, wherein said plug-in section is inserted into said receiving section.

4. The solid anode X-ray tube of claim 3, wherein said front part has a longitudinal bore extending to a bottom of said recess of said receiving section, said front part also having a transverse bore which is connected to said longitudinal bore, wherein said transverse bore terminates outside of said receiving section.

5. The solid anode X-ray tube of claim 2, wherein said rear part and the front part are connected to each other through shrinking.

6. The solid anode X-ray tube of claim 1, wherein said ceramic material of said insulating body is aluminum oxide ($Al_2O_3$) and said first metallic material of said rear part is made of an iron nickel cobalt alloy.

7. The solid anode X-ray tube of claim 6, wherein said iron nickel cobalt alloy has weight portions of Fe=53-54%, Ni=28-29% and Co=17-18%.

8. The solid anode X-ray tube of claim 1, wherein said second metallic material is Cu.

9. The solid anode X-ray tube of claim 1, wherein a front end of said front part has a coating, a top part or an insert of molybdenum, tungsten, rhodium, silver, cobalt or chromium.

10. The solid anode X-ray tube of claim 1, wherein a rear end of said rear part comprises a connector section having a recess for receiving a high voltage plug.

11. The solid anode X-ray tube of claim 1, wherein said cooling device comprises a metallic sheathing on said insulating body.

12. The solid anode X-ray tube of claim 1, wherein said rear part is soldered into said insulating body with a solder containing Ag or Au, said insulating body having a nickel-plated molybdenum manganese (MoMn) coating, at least in a soldered area thereof.

13. A method for producing the vacuum feed through of the solid anode X-ray tube of claim 1, the method comprising the steps of:

a) producing the insulating body;

b) inserting the rear part of the anode into the hollow space of the insulating body and vacuum-tight soldering of the rear part into the insulating body; and c) mounting the front part of the anode to the rear part.

14. The method of claim 13, wherein said front part is mounted to said rear part in step c) through placing on top and shrinking.

15. The method of claim 13, wherein steps a) and b) are initially performed for a plurality of vacuum feed throughs and partly finished vacuum feed throughs are subsequently provided with front parts, either individually or in groups in accordance with step c), wherein various different types of front parts are used.

* * * * *